United States Patent [19]

Henrickson

[11] 3,942,765

[45] Mar. 9, 1976

[54] STATIC MIXING APPARATUS

[75] Inventor: Angus V. Henrickson, Golden, Colo.

[73] Assignee: Hazen Research, Inc., Golden, Colo.

[22] Filed: Sept. 3, 1974

[21] Appl. No.: 502,871

[52] U.S. Cl. ..... 259/4 R

[51] Int. Cl. ..... B01f 15/00

[58] Field of Search ..... 259/4, 18, 36; 138/38, 138/42; 48/180 R, 180 M, 180 B; 239/476; 23/252 R

[56] References Cited

UNITED STATES PATENTS

| | | | |
|---|---|---|---|
| 1,961,744 | 6/1934 | Durkee | 138/38 |
| 2,601,018 | 6/1952 | Heyl | 259/4 |
| 2,628,864 | 2/1953 | Rogers | 239/476 |
| 2,660,198 | 11/1953 | Morrow | 138/38 |
| 2,852,042 | 9/1958 | Lynn | 138/38 |
| 3,203,371 | 8/1965 | Mosey | 259/4 |

*Primary Examiner*—Robert W. Jenkins
*Attorney, Agent, or Firm*—Sheridan, Ross & Fields

[57] ABSTRACT

There is provided an improved static mixing apparatus which comprises in combination a tubular body and a static mixing element preferably coextensive in length with the tubular body and disposed therein in fluid flow intercepting relation. The static mixing element is characterized by a plurality of alternately oppositely extending first triangular elements from a common center line whereby the laterally extending first triangular elements are in axially staggered relation, and a plurality of second triangular members each having one apex on the common center line and each having a side in common with a first triangular element, and each of the second triangular elements lying in a plane angularly related to the first triangular element with which it has a side in common.

The second triangular elements lie in sectors about the common center line. These devices are particularly useful for mixing a plurality of materials in the same or different states, miscible or immiscible, soluble or insoluble, and reactive or nonreactive.

16 Claims, 9 Drawing Figures

AQUEOUS
ORGANIC
ORGANIC
AQUEOUS

STATIC MIXING APPARATUS

BACKGROUND OF THE INVENTION AND PRIOR ART

The concept of mixing materials by utilizing "static" or motionless mixing has been known for sometime. In the past 4 years, two designs have been available on the market one of which consists of a series of helical elements in a tube or pipe, and the other of which utilizes a complex series of tubular channels. Both of these structures divide and recombine a stream in geometric progression, and within a relatively short distance, feed stock material is thoroughly and predictably mixed. ("Automation", February 1972 "Motionless Mixers"). The helical element type of device is clearly disclosed in U.S. Pat. No. 3,286,992 to Armeniades et al. dated Nov. 22, 1966. These devices are called motionless mixers because they have no moving parts. Relative movement of the fluid with respect to the motionless mixing elements is, however, achieved by the flow of fluid within the conduit.

Other efforts at blending various materials include the patent to Heyl et al. No. 2,601,018 wherein the blending tube contains a single perforated sheet metal spiral member substantially throughout its length, the perforated surface of the spiral member extending from wall to wall of the blending tube. Rogers in U.S. Pat. No. 2,628,864 is disclosing an aerosol paint spraying device taught the use within the spray tube of a spiral form member formed either of twisted wire or a helical ribbon of metal. Andrews et al. in U.S. Pat. No. 2,710,250 taught the mixing of fluids with a series of orifice members in a conduit. Grubb et al. U.S. Pat. No. 2,863,649 taught an apparatus for mixing on a small scale of compositions having a short period of coexistence when mixed and utilizing a rotating mixing rod having a small wire spirally wound around it and including at regularly spaced intervals spiral notches. Another device is taught in the patent to Thomas et al. U.S. Pat. No. 3,089,683 wherein an elongated tubular body is provided with a series of diffusers which create a turbulent flow of the liquids thereby ensuring a complete mixture of the liquids prior to ejection through the outlet. U.S. Pat. No. 3,203,371 to Mosey teaches a machine for whipping of confectionary filling utilizing in the nozzle thereof a baffle which comprises a strip of chrome steel twisted into a helical form and having a plurality of transverse slits to provide a multplicity of teeth or tongues which extend more or less radially from the axis of the helical bent strip.

The present invention is distinguished from these prior art devices in that the motionless mixing element is a singular structure of far simpler geometric configuration then that heretofore proposed and therefore much less costly in either fabrication or disassembly and cleaning than prior art structures.

BRIEF STATEMENT OF THE INVENTION

Briefly stated, therefore, the present invention is in a motionless mixing apparatus which comprises in combination a tubular body and a motionless mixing element disposed within the tubular body in fluid flow intercepting relation therein. The mixing element comprises an elongated member having a plurality of alternately oppositely extending first triangular elements from a common center line which forms a side of each said first triangular elements whereby the alternately oppositely extending first triangular elements are in axially staggered relation. There is also provided a plurality of second triangular members each having an apex on the common center line and each having a side in common with at least a portion of a side of a first triangular element, each of the second triangular elements lying in a plane angularly related to the plane of the first triangular element with which it has a side in least in part in common. In a preferred embodiment of the present invention, the first triangular elements all lie in a common plane. The second triangular elements each lie in a plane which is at right angles to the plane of the first triangular member with which it has a side in common. Conveniently, although not essentially, the triangular elements are right triangles, for example 30° right triangles.

BRIEF DESCRIPTION OF THE DRAWINGS

The present invention may be better understood by having reference to the annexed drawings wherein.

DETAILED DESCRIPTION OF THE DRAWINGS

Figures 1, 2A, 2B, 3, 4, 5, 6, 7, 8:
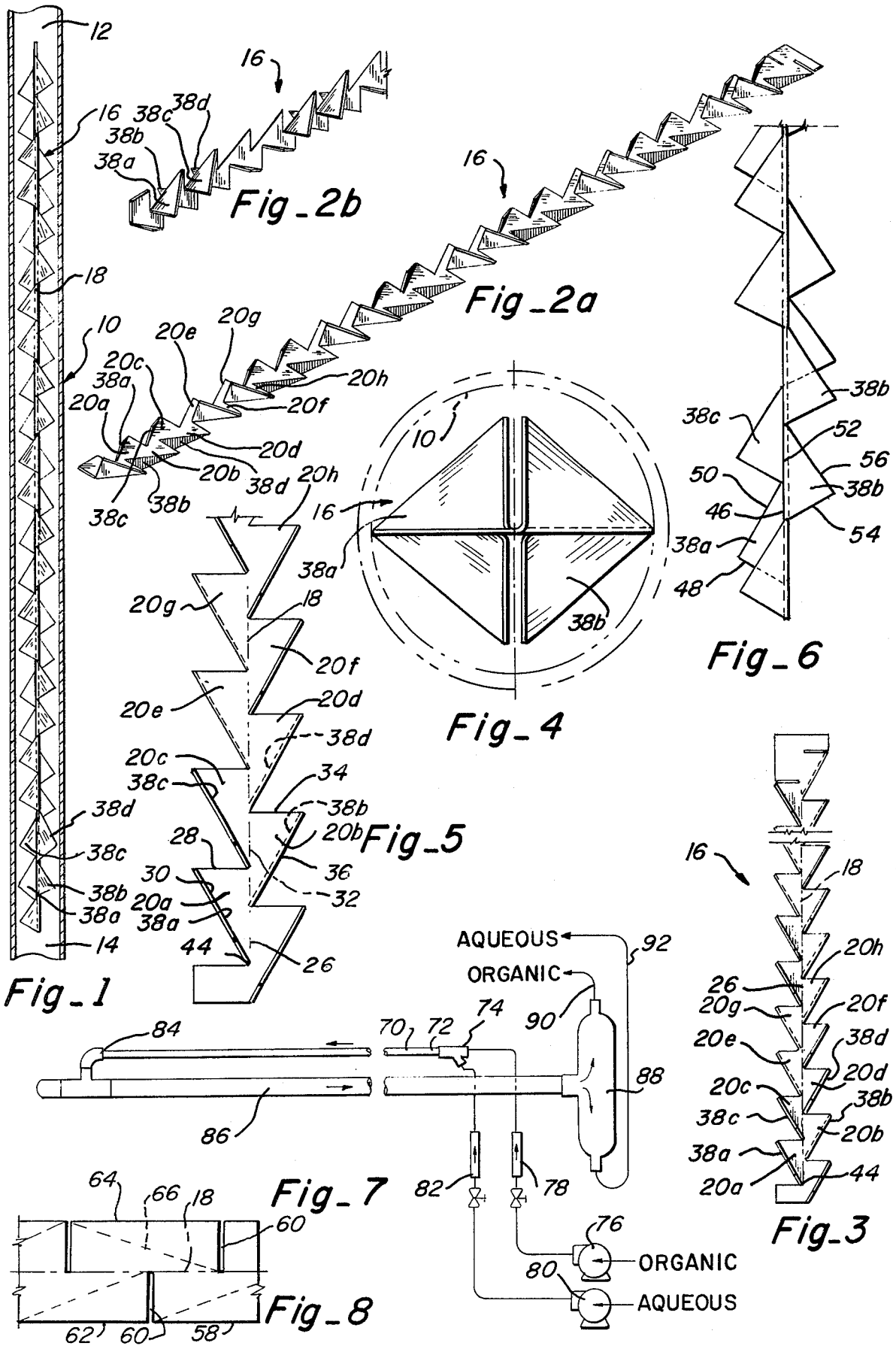
FIG. 1 is a cross sectional view of a motionless mixing apparatus of the present invention employing a preferred motionless element therein.
FIGS. 2*a* and 2*b* are perspective views of the motionless mixing element shown in FIG. 1.
FIG. 3 is a top plan view of the motionless mixing member shown in FIG. 2.
FIG. 4 is an end view on an enlarged scale of the apparatus shown in FIG. 1.
FIG. 5 is a top plan view on an enlarged scale of a portion of the mixing element shown in FIG. 3.
FIG. 6 is a side elevation of the portion shown in FIG. 5.
FIG. 7 is a schematic illustration of a single stage solvent extraction unit employing a motionless mixing apparatus in accordance with the present invention.
FIG. 8 shows a portion of a blank from which the preferred motionless mixing elements may be formed by bending along the diverging diagonals of successive oppositely extending rectangular member according to a predetermined pattern.

Referring now more particularly to FIG. 1, there is here shown a tubular member 10 having an inlet end 12 and an outlet end 14. The tubular member 10 may be formed of any suitable material which will not be affected by or reactive with the materials or any one of them being mixed. In some cases, therefore, the tubular member may be formed of plastic, or glass, or a section of iron or cast iron pipe, or clay, as may be described. The cross section is desirably circular although a rectangular cross section may as well be used. The materials to be mixed are conveniently introduced through a Y-fitting at the inlet end as will be illustrated in FIG. 7. The mixing element 16 is positioned within the tubular member in fluid flow intercepting relation.

Referring now to FIGS. 2*a*, 2*b*, 3, 4, 5 and 6, FIGS. 2*a* and 2*b* show in perspective the mixing element generally indicated by the numeral 16. For convenience, a center line 18 is shown and provides a reference from which conveniently to describe the illustrated embodiment of the present invention. The center line 18 lies in a plane. What will be designated for convenience as first triangles 20 also lie in the same plane. The first triangles 20 alternately oppositely extend from the center line 18. Thus, first triangles 20*a*, 20*b*, 20*c* and 20*d* alternately extend first to the left then to the right, then to the left and then to the right, for example, of center line 18. This pattern persists for the length of the mixing element 16, and illustrates what is meant by the language "alternately oppositely extending first triangular elements from a common center line 18." Considering, for the moment, the first triangle 20*a*, it will be observed that it is composed of a base line 26, a radial line 28 and a hypotenuse 30, the first triangle 20*a* being a right triangle. The base line 26 coincides with the center line 18. Considering the first triangle 20*b*, it is composed of a base line 32, a radial line 34, and a hypotenuse 36. The base line 32 of the first triangle 20*b* also coincides with the centerline 18. In the preferred embodiment illustrated in FIGS. 2–6, the base line 32 of the first triangle 20*b* also coincides with a portion of the base line 26 of the first triangle 20*a*. The extent of the overlap or coincidence of the base line 32 with the base line 26 is a matter of choice and, as shown in the preferred embodiment is approximately one half the length of the respective base lines 26 and 32. This illustrates what is meant by the language "axially staggered and overlapping relation." It should be understood that while an overlap to the extent of one half of the base line of contiguous first triangles is a preferred arrangement, it is by no means an essential arrangement, and the extent of overlapping may be zero or up to 75%, with a 50% overlap being preferred.

In addition to the first triangles 20, there is provided a plurality of second triangular members 38 which members are disposed out of the plane of the first triangular members 20. Consider, therefore, second triangular members 38*a*, 38*b*, 38*c* and 38*d*. Each of these triangles 38*a*, 38*b*, 38*c* and 38*d* has an apex on the common center line 18, and each of the second triangular members 38*a*, 38*b*, 38*c* and 38*d*, has a side in common with a first triangular element 20. Consider, therefore, second triangular members 38*a*. It has an apex 44 lying on the common centerline 18. Also, it has a side 46 which is in common with the side 30 of the first triangular member 20 a and in the embodiment shown, in coextensive therewith. It has been found convenient, and therefore illustrated in the preferred embodiment that the second triangular members 38 should also be right triangles as are the first triangles 20. Thus the side 46 of the second triangular member 38*a* is indeed a hypotenuse and coincides with the hypotenuse 30 of the first triangular member 20*a*. The sides 48 and 50 of the second triangular member 38*a* intersect at a 90° angle, and again, although not essentially, the right triangle 38*a* is a 30, 60, 90° right triangle as is the right triangle 20*a*.

As shown in FIGS. 2*a* and 2*b*, the right triangle 38*a* is bent out of the plane of the right triangle 20*a* and extends upwardly as it appears in FIGS. 5 and 6. In like but opposite and staggered manner, the triangle 38*b* is bent downwardly along the hypotenuse 36 of the first triangular member 20*b*. Thus, the right triangle 38*b* is bounded by the hypotenuse 52, the radial line 54 extending from the centerline 18, and the side 56. The triangles 38*a* and 38*b* are angularly related to the planes of their respective contiguous first triangular members 20*a* and 20*b*, that angle being in the preferred embodiment shown in FIGS. 2–6 a 90° angle.

Considering the first triangle members 20*a*, 20*b*, 20*c* and 20*d*, these first triangles 20 in the order named are proceeding serially and axially in the direction toward what I shall for convenience denominate "the inlet", the vantage point of viewing the mixing element as shown in FIG. 4 being from the outlet end. The pattern of disposing the second triangle members 38*a*, 38*b*, 38*c* and 38*d* with respect to their respective contiguous first triangular members 20*a*, 20*b*, 20*c* and 20*d*, and as shown in FIGS. 5 and 6 is that the second triangular member 38*a* is bent upwardly with respect to its contiguous first triangular member 20*a*, the second triangular member 38*b* is bent downwardly with respect to its contiguous first triangular member 20*d;* the second triangular member 38*c* is bent upwardly with respect to its contiguous first triangular member 20*c*, and the second triangular member 38*d* is bent downwardly with respect to its contiguous first triangular member 20*d*. Again regarding the device from the outlet end, in this first group of four first triangular members 20, the pattern of bending to form the second triangular members 38 is up-down-up-down. Thus, as one proceeds axially toward the inlet end of the device, the bending pattern is helical in a clockwise direction. With the next set of four first triangle members 20*e*, 20*f*, 20*g* and 20*h*, the bending pattern to form the second triangular members 38*e*, 38*f*, 38*g* and 38*h* is just the opposite, i.e., counterclockwise and follows the pattern down-up-down-up.

The length of the motionless mixing element 16 is, in the preferred embodiment, therefore, desirably divided into segments of equal length wherein the bending pattern alternates between up and down in a clockwise manner when viewed from the outlet end followed by a bending pattern in the next adjacent segment in a counter-clockwise fashion, followed by a bending pattern in the next succeeding segment in a clockwise manner, etc. The length of the individual segments as above described is immaterial, and whereas in the preferred embodiment, each segment is composed of four succeeding first triangular members 20, the segment may be composed of any even number of first triangular members 20 in sequence with the bending pattern following first upward then downward then upward, etc. bending.

While reference has been had to "bending" in describing mixing element 16, this is only occasioned by reason that it has been found most convenient to form the motionless mixing elements 16 from a flat piece of metal, e.g., stainless steel sheet from a blank which appears as shown in FIG. 8. The blank 58 shown in FIG. 8 is conveniently slotted along alternately laterally extending lines 60. With the centerline 18 extending along the blank 58, it can readily be seen that the centerline 18, the slit lines 60 and the lower marginal edge 62 of the blank 58 define a series of rectangles lying below the centerline 18. Likewise, the upper marginal edge 64 of the blank 58 in combination with the centerline 18 and the radiating lines 60 define a series of rectangular members. Since the lines 60 alternately extend to the below and then above, the rectangular members so defined are in alternating oppositely extending staggered and overlapped relation. When the rectangular members are bent along the diagonals 66 shown in dotted lines and converging upon the centerline 18, the bending being in the pattern above described for each of the succeeding segments, the first triangular members 20 and the second triangular members 38 are readily and conveniently formed. Bending is desirably to an angular relationship with the first triangular member 20 of 90°. When viewed from the outlet end as shown in FIG. 4, it will be seen that there is no clear path for the fluid to take as it proceeds from the inlet to the outlet all quadrants are substantially blocked by upstanding or depending second triangular members 38. While a circular cross section has been shown for the tubular member 10, and there is necessarily some free space between the sides 50 and 56, for example and the tubular member 10, this is not regarded as material in the light of the convenience and inexpensive mode of fabrication the motionless mixing elements 16 in the preferred embodiment illustrated and as described above. The tubular member 10 might as well be provided with a square or rectangular cross section.

This apparatus has been tested and has demonstrated superior mixing characteristics in liquid-liquid extraction system, wherein, two immiscible phases are intimately dispersed to permit transfer of a soluble constituent from the aqueous phase to the organic phase.

FIG. 7 shows as apparatus incorporating a mixer in accordance with the present invention. Thus, there is shown in FIG. 7 in schematic and diagrammatic fashion a mixer tube 70 which although it cannot be seen in FIG. 7 contains an elongated mixing element such as that shown in FIGS. 2–6. The inlet end 72 is attached to one leg of a Y-fitting 74, one arm of which is connected to a source of organic medium pumped therethrough by means of a pump 76 and controlled by means of a flow meter 78, and wherein the other arm is connected to an aqueous medium source pumped thereto by means of a pump 80 through a flow meter 82.

By the time the immiscible organic and aqueous phases have traversed the length of the tube 70 and emerge at the outlet end 84, the degree of subdivision of the organic phase in the aqueous phase is quite fine. The dispersion or emulsion, as the case may be, enters the settler portion 86, the fluid flows in to a T-shaped settling tube of relatively large diameter with the laterally extending arms in a vertical position. The organic phase containing the solute being lighter than the water rises to the top and is exhausted through the line 90. The aqueous phase is exhausted through line 92. Because the fluid velocity in the mixer 70 can be set to give uniform droplet size, coalescence is fast and requires a shorter retention time. After the mixing section 70, the mixed solvent and aqueous phases are discharged into the enlarged section of pipe 86 so that turbulance is reduced to a minimum and the phases are given an opportunity to separate. The length of the settler 86 which is required is dependent on the phase separation characteristic of the two fluids and is a function of the specific gravity, viscosity and surface or interfacial tension.

An apparatus of the type shown in FIG. 7 has been used in the solvent extraction of copper from a dilute aqueous copper sulphate solution with kerosene solution of 2-hydroxybenzophenoxime whereby copper is exchanged into the organic phase. Comparative studies were made using the mixing device of the present invention in a system as shown in FIG. 7, and using a conventional tank mixer-settler system.

It has been determined that a single stage of the extraction circuit shown in FIG. 7 which handles 1000 gallons dilute aqueous copper sulphate (1 to 2 gms. per liter) and 1500 gallons of the organic phase per minute requires a mixer 70 which is 14 inches in diameter and approximately 80 feet long. The settler 86 is then approximately 5 feet in diameter and approximately 40 feet long. This provides a fluid velocity of about 5.2 feet per second in the mixer 70 and a mixing time of 15 seconds. The fluid velocity in the settler 86 is approximately 0.28 feet per second and retention time 143 seconds. The volume of solvent in the mixer 70 and settler 86 is approximately 4000 gallons.

For comparative purposes, a conventional tank mixer-settler system which will handle 1000 gallons per minute of aqueous flow requires 2 minutes retention in the mixer and 0.5 square feet of settler area per gallon per minute of total flow. Assuming a solvent aqueous ratio of 1.5 to 1 in the mixer and solvent depth of 8 inches in the settler, the volume of solvent in one stage will be approximately 10,000 gallons. This difference can be realized for a large size solvent extraction plant. The capital cost for a system such as that shown in FIG. 7 has been extimated to be approximately 75% of the conventional type mixer-settler system.

The conditions of extraction vary, of course, with different systems and the mixer portion of the apparatus may be relatively shorter or longer depending upon these conditions, e.g. phase separation rate, solvent power of organic phase with respect to the solute, ion-exchange rate between phases, etc. It should also be noted that while, for convenience in description, reference has been made to an inlet end and an outlet end of the motionless mixing element, fluid flow may be in either direction relative to the mixing elements of the present invention with equivalent results.

The invention has been described in detail with particular reference to a referred embodiment thereof, but it will be understood that variations and modifications can be effected within the spirit and scope of the invention as described hereinabove and within the scope of the claims appearing below.

What is claimed is:

1. A motionless mixing apparatus comprising in combination:

a. a tubular body;

b. a motionless mixing element disposed within said tubular body in fluid flow intercepting relation, said mixing element comprising:

1. an elongated member having a plurality of alternately oppositely extending first triangular elements from a common centerline which forms a side of each said first triangular element, each of said first triangular elements lying on one side of said common centerline having a side in common with a portion of the sides of two oppositely extending first triangular elements lying on the other side of said common centerline, whereby said laterally extending first triangular elements are in axially staggered and overlapping relation, and 2. a plurality of second triangular members each having one apex on said common centerline and each having a side in common with a first triangular element, each of said second triangular elements lying in a plane angularly related to the first triangular element with which it has a side in common.

2. A motionless mixing apparatus in accordance with claim 1 wherein the second triangular members each lie in a plane at right angles to the plane of the first triangular member with which it has a side in common.

3. A motionless mixing apparatus in accordance with claim 1 in which the first triangular elements are right triangles.

4. A motionless mixing apparatus in accordance with claim 3 in which the first triangular elements are 30° right triangles.

5. A motionless mixing apparatus in accordance with claim 4 in which the 30° angle of the first triangular members includes the side common to the common centerline.

6. A motionless mixing apparatus in accordance with claim 1 in which the first and second triangular elements are right triangles.

7. A motionless mixing apparatus in accordance with claim 6 wherein the common side between a first triangular member and its second triangular member is the hypotenuse of each.

8. A motionless mixing apparatus in accordance with claim 6 in which the first and second triangular elements are 30° right triangles.

9. A motionless mixing apparatus in accordance with claim 8 in which the 30° angle of the first triangular members includes the side common to the common centerline.

10. A motionless mixing apparatus in accordance with claim 1 wherein the second triangular members on axially succeeding first triangular members occupy a position in serial sectors about said common centerline.

11. A motionless mixing apparatus in accordance with claim 10 in which the sectors are each 90°.

12. A motionless mixing apparatus in accordance with claim 1 wherein the first and second triangular members are formed by folding staggered bilaterally extending rectangular sections along a diagonal thereof whereby the apices of successive first triangular members alternately oppositely extending from said common centerline also successively proceed along the common centerline.

13. A motionless mixing apparatus in accordance with claim 1 in which the first triangular members all lie in a common plane.

14. A motionless mixing apparatus in accordance with claim 1 in which the motionless mixing element is formed from stainless steel sheet.

15. In a motionless mixing apparatus having a tubular fluid conduit and stationary mixing means disposed in said tubular fluid conduit, the improvement which comprises: a single stationary mixing element coextensive with said conduit comprising a. an elongated member having a plurality of alternately oppositely extending first triangular elements from a common centerline which forms a side of each said first triangular element, each of said first triangular element, each of said first triangular elements lying on one side of said common centerline having a side in common with a portion of the sides of two oppositely extending first triangular elements lying on the other side of said common centerline, whereby said laterally extending first triangular elements are in axially staggered and overlapping relation, and b. a plurality of second triangular members each having one apex on said common centerline and each having a side in common with a first triangular element, each of said second triangular elements lying in a plane angularly related to the first triangular element with which it has a side in common.

16. A motionless mixing apparatus comprising in combination:

a. a tubular body;

b. a motionless mixing element disposed within said tubular body in fluid flow intercepting relation, said mixing element comprising:

1. an elongated member having a plurality of alternately oppositely extending first triangular elements from a common centerline which coincides with a side of each of said first triangular elements, whereby said alternately oppositely extending first triangular elements are in axially staggered relation; and 2. a plurality of second triangular members each having one apex on said common centerline and each having a side in common with at least a portion of a side of a first triangular element, each of said second triangular elements lying in a plane angularly related to the plane of the first triangular element with which it has a side at least in part in common.

* * * * *